US008770133B2

(12) United States Patent
Dufour

(10) Patent No.: US 8,770,133 B2
(45) Date of Patent: Jul. 8, 2014

(54) DEVICE FOR ASSISTING IN THE PRACTICE OF TOWED SLIDE SPORTS

(76) Inventor: Gerard Dufour, Paris (FR)

( * ) Notice: Subject to any disclaimer, the term of this patent is extended or adjusted under 35 U.S.C. 154(b) by 0 days.

(21) Appl. No.: 13/320,951

(22) PCT Filed: May 28, 2010

(86) PCT No.: PCT/FR2010/000396

§ 371 (c)(1),
(2), (4) Date: Mar. 22, 2012

(87) PCT Pub. No.: WO2010/136675

PCT Pub. Date: Dec. 2, 2010

(65) Prior Publication Data

US 2012/0174850 A1 Jul. 12, 2012

(30) Foreign Application Priority Data

May 28, 2009 (FR) ..... 09 02582
May 11, 2010 (FR) ..... 10 02016

(51) Int. Cl.
*B63B 17/00* (2006.01)

(52) U.S. Cl.
USPC ..... 114/343; 114/253; 440/33; 441/72

(58) Field of Classification Search
USPC ..... 114/253, 343; 440/33
See application file for complete search history.

(56) References Cited

U.S. PATENT DOCUMENTS 3,156,935 A 11/1964 Long
4,554,881 A * 11/1985 Lane ..... 114/121
4,557,439 A * 12/1985 Puskas ..... 244/63
5,094,638 A * 3/1992 Kobayashi ..... 440/33
5,367,972 A * 11/1994 McCulloh ..... 114/253
6,102,760 A 8/2000 Seigler
7,097,523 B2 * 8/2006 Woolley ..... 441/72
7,216,600 B1 5/2007 Hamilton
7,314,014 B2 * 1/2008 Heyring et al. ..... 114/61.15
7,762,206 B2 * 7/2010 Seipel et al. ..... 114/343
2002/0025746 A1 2/2002 Murphy
2005/0255764 A1 11/2005 Woolley

FOREIGN PATENT DOCUMENTS

DE 102005055561 A1 5/2007
WO 98/17530 A1 4/1998

OTHER PUBLICATIONS

International Search Report issued Oct. 6, 2010 by European Patent Office re: PCT/FR2010/000396; citing: US 2002/025746 A1, US 2005/255764 A1, DE 10 2005 055561 A1, WO 98/17530 A, US 7,216,600 B1, US 6,102,760 A and US 3,156,935 A.

* cited by examiner

*Primary Examiner* — Lars A Olson
*Assistant Examiner* — Jovon Hayes
(74) *Attorney, Agent, or Firm* — Cantor Colburn LLP

(57) ABSTRACT

The present invention relates to a device for practicing towed boardsports while avoiding falls and saving time in learning, teaching, and progressing. The device consists of a rigid structure (2, 9) connected to a towing vehicle and provided with a means (3, 4) for suspending a user (5) such that the latter no longer falls. The means for suspending a user includes a rope attached to the top of the structure, at the end of which a harness for suspending the user (5) is attached. The user (5) is suspended under the device. Thus suspended, the user (5) no longer falls. The device of the invention is particularly suitable for boardsports towed by motor boats.

8 Claims, 3 Drawing Sheets

FIG.1 (profile view)
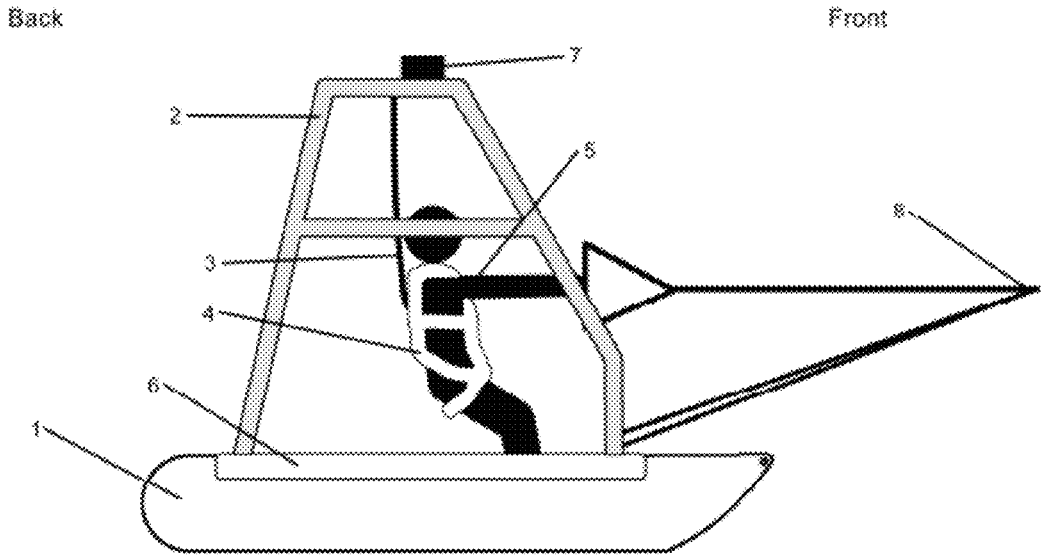
FIG.2 (front view)
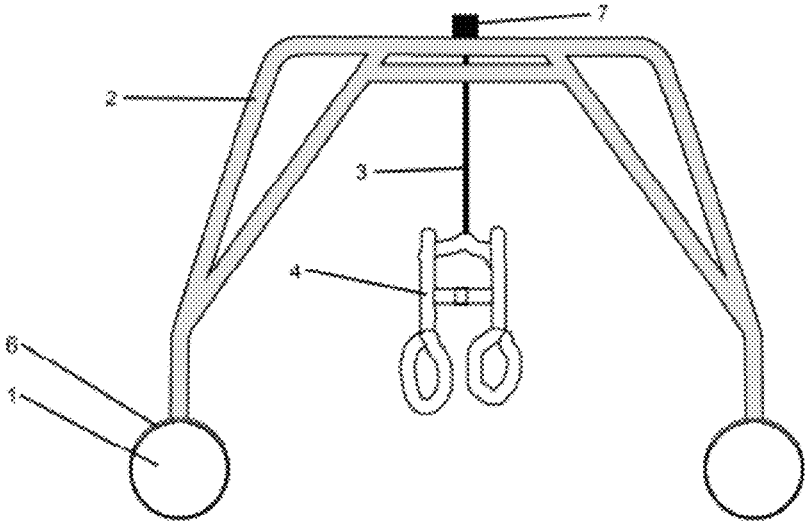

FIG.3 (top view)
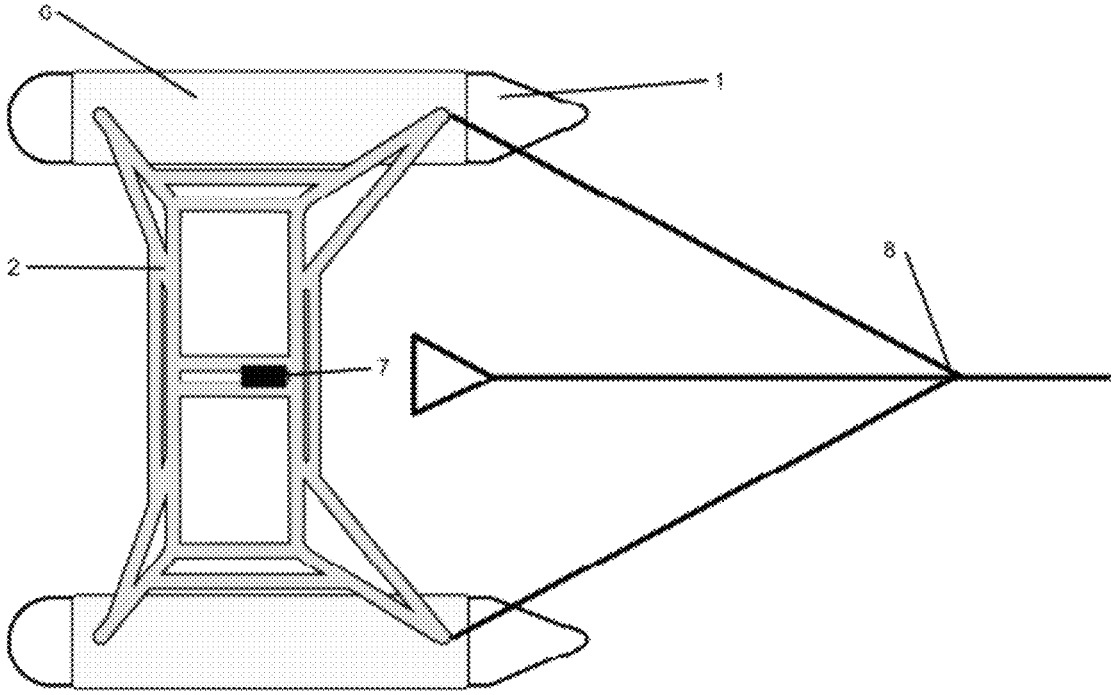

FIG.4 (rear view)
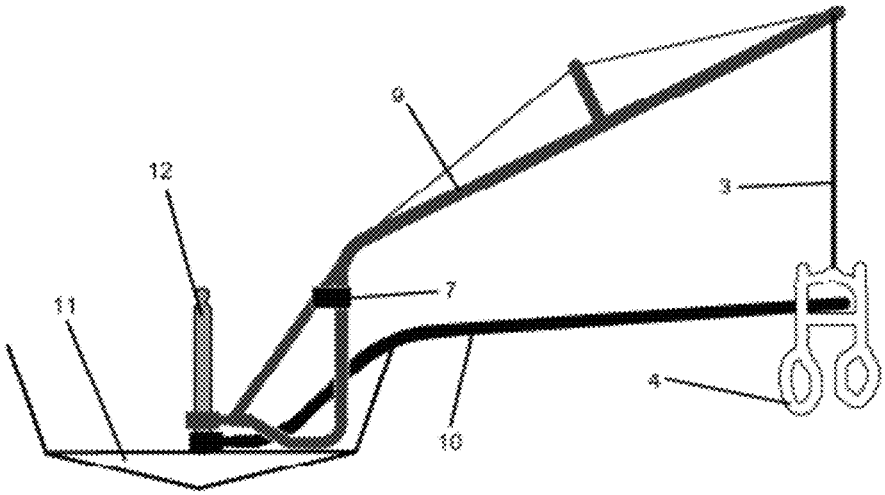
FIG.5 (top view)
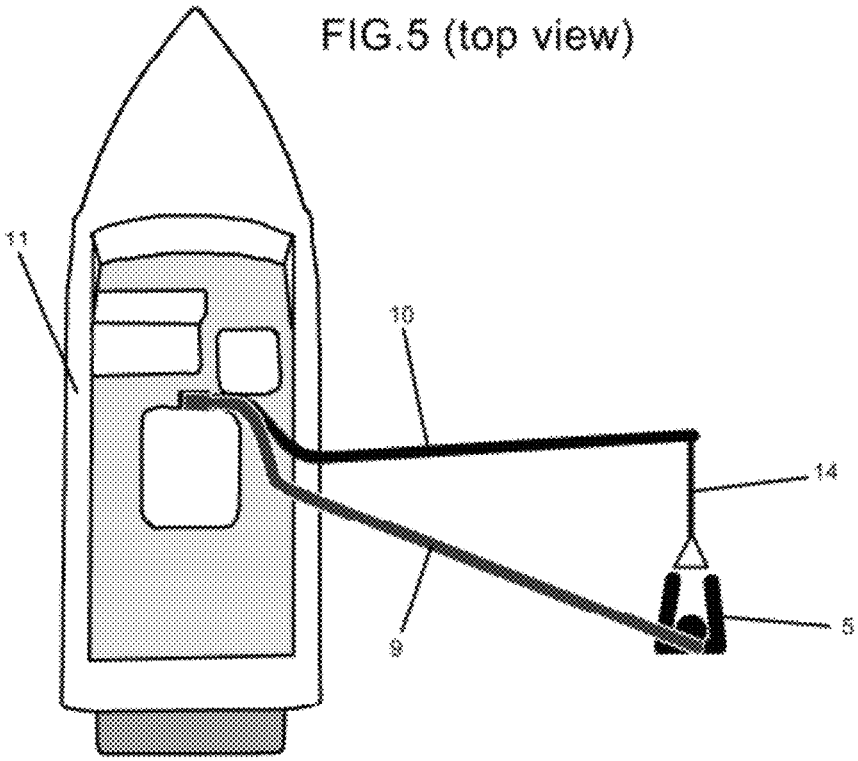

DEVICE FOR ASSISTING IN THE PRACTICE OF TOWED SLIDE SPORTS

TECHNICAL FIELD

This invention concerns a device that is used when practicing towed slide sports, preventing falls (for example: for waterskiing and other slide sports towed by boats or other towing mechanisms). This invention is adapted for slide sports towed by a motor boat.

BACKGROUND

When falls are avoided, not only does the apprehension of falling disappear but there is no time wasted recuperating the skier.

The practice of slide sports which are towed by boats generates a feeling of fear for the participants. From beginner to competitor, falling is unavoidable, some falls being violent and involving injuries and at times even handicaps. Some beginners are afraid of falling and of hurting themselves, others fear being totally immersed when starting or when they fall. Experienced participants and competitors apprehend the violence of repetitive falls.

Furthermore, each fall, each failure at the start and each involuntary rope drop causes an important loss of time for the recuperation of the skier: the boat has to turn round, slowly approach the skier, do a half circle maneuver in order that the rope is accessible for the skier, tighten the rope, restart and finally reach the right speed so that the skier is able to evolve on the water.

BRIEF SUMMARY

Therefore, this device allows the practice of slide sports which are towed, preventing falls and saving time during the apprenticeship, teaching and the progression of the user.

The device according to the invention provides a solution to these inconveniences. This is an assistance device for practicing towed slide sports, wherein characterized by a rigid structure (2 or 9) which is connected to a towing machine and which provides a means of support and suspension (3 and 4) for the user (5).

The given means which is destined to suspend the user is comprised of a rope (3) attached to the top of the structure (2 or 9) and at the end of which a harness (4) is attached in order to suspend the user (5).

The given means which is destined to suspend the user can be adjusted in height by using a winch or an articulated arm. In the case of a winch, it can either be electric or manual, with or without a remote control.

According to a first version:

the given rigid structure is comprised of elements allowing sliding (1) and of a structure in the form of an arch (2) positioned on the part that ensures le slide.

BRIEF DESCRIPTION OF THE DRAWINGS

A device for assisting in the practice of towed slide sports is shown in various positions and configurations in FIGS. 1 to 3.

DETAILED DESCRIPTION

The user (5) is equipped with a harness (4) called <<working harness>> either with a single attachment point located in between the shoulder blades or with a <<parachute>> type of harness with two attachment points above each shoulder. Due to this harness the skier is suspended by a rope (3) at the top of the arch (2). The skier evolves inside the device (that is to say, under the arch and in between the elements that ensure the slide). Thus suspended to a rope the skier can no longer fall. The practice of slide sports which are towed by boats now become accessible to a large population, including those who have back or neck problems, the disabled . . .

the device is characterised of what the given structure is comprised of—a means of ensuring buoyancy (1).

The structure is positioned and fixed to an element that ensures buoyancy, for example two floaters used as just like catamaran floaters. The front of the floaters are shaped like the front of skis in order to facilitate the skier's evolution at high speed on agitated water.

The given means that ensure buoyancy are equipped with curved and rigid plates (6) which are attached to each side of the arch structure (2). These floaters respect French standards applicable to semi-rigid boat floaters.

The user, as well as the device, are towed horizontally by a rope that can be adjusted in length (8).

The device can therefore be adapted to all sizes of user, but as well to all positions (low or high) that different towed sports require.

This version of the concept is more complex and costly than the following variation, but it allows the user to evolve in realistic conditions of the majority of towed slide sports: that is, behind a traction engine.

Another variation of the apparatus involves the rigid structure (9) of the device being attached by an extremity to the towing device (11). It is represented in FIGS. 4 and 5.

This variation is more simple and less costly due to its conception, but it can only be used when the user evolves next to the towing device (towed by a commonly used device: a traction boom (10) and a short (14) rope).

Following this variation, the rigid structure is pole shaped (9), the rope destined to suspend (3) the user (5) in his harness (4) being attached to his free extremity.

The invention also includes the given device and a traction device that assists the practice of towed slide sports, the traction device that assists in the practice of towed slide sports being connected to the towing engine by the means of an adjustable rope (8).

This device for assisting in the practice of towed slide sports can be integrated to the towing engine: the towing engine either has an lateral addition comparable to a catamaran under which the user evolves whilst being towed by a <<boom>>. Or the towing device can be <<U-shaped>> and is comprised of a pit inside of which the user evolves whilst being towed by a rope which is fixed to the front of the towing engine (this being comprised of the <<cockpit>> being either placed laterally or above). The device can also be fixed on a towing engine and a lateral addition which is attached to the top of the structure enables the user to evolve suspended to the side of the towing engine.

The whole of the device has for function to be towed by the same rope that tows the user (8).

The overall size of the device is adapted to an tall human being.

The entire device can be dismantled and transported. This device for assisting the practice of towed slide sports, particularly slide sports towed by boats, could be also adapted to snow sports (towed by ski-do), and also on hard surfaces (for example: roller skating towed by a Quad).

The invention claimed is:

1. A towing device for assisting in a practice of towed slide sports, comprising: a structure which is connected to a towing machine and which provides a means of support and suspension for a user, wherein the means of support and suspension further include only a rope attached to a top of the structure and a harness directly connected to the rope, wherein the harness is configured for suspending the user, wherein the means of support and suspension can be adjusted in height by using a winch.

2. The towing device according to claim 1, wherein the structure is comprised of elements allowing sliding and of a structure in a form of an arch positioned on a part that ensures the slide.

3. The towing device according to claim 2, further comprising means that ensure buoyancy.

4. The towing device according to claim 3, wherein the means that ensure buoyancy are equipped with curved plates which are attached to each side of the arch structure.

5. The towing device according to claim 1, wherein the structure is attached by an extremity to the towing machine.

6. The towing device according to claim 1, wherein the structure is pole shaped, the rope configured to suspend the user in the harness being attached to a free extremity.

7. Assembly comprised of the towing device for assisting in the practice of towed slide sports according to claim 1 and a towing engine for the towing device for assisting in the practice of towed slide sports, the towing device for assisting in the practice of towed slide sports being connected to the towing engine by means of an adjustable rope.

8. Assembly comprised of the towing device for assisting in the practice of towed slide sports according to claim 1 and a towing engine for the towing device for assisting in the practice of towed slide sports, wherein the towing device for assisting in the practice of towed slide sports which is attached to the towing engine.

* * * * *